US011235205B2

(12) United States Patent
Heylmun

(10) Patent No.: US 11,235,205 B2
(45) Date of Patent: Feb. 1, 2022

(54) HYPER-ACUITY GOLF CLUB SIGHT LINES

(71) Applicant: David Clayton Heylmun, Denver, CO (US)

(72) Inventor: David Clayton Heylmun, Denver, CO (US)

(73) Assignee: Heylmun Holdings LLC, Whitehall, MI (US)

( * ) Notice: Subject to any disclaimer, the term of this patent is extended or adjusted under 35 U.S.C. 154(b) by 0 days.

(21) Appl. No.: 16/687,217

(22) Filed: Nov. 18, 2019

(65) Prior Publication Data

US 2021/0146200 A1 May 20, 2021

(51) Int. Cl.
*A63B 53/04* (2015.01)

(52) U.S. Cl.
CPC ..... *A63B 53/04* (2013.01); *A63B 53/0441* (2020.08)

(58) Field of Classification Search
CPC ..... A63B 53/04; A63B 53/0441; A63B 2071/0694; A63B 2209/02
See application file for complete search history.

(56) References Cited

U.S. PATENT DOCUMENTS 3,954,265 A * 5/1976 Taylor ..... A63B 53/007 473/252
4,128,244 A 12/1978 Duclos
5,720,668 A 2/1998 Brett
5,839,970 A * 11/1998 Lombardo ..... A63B 69/3685 473/252
5,980,393 A * 11/1999 Molinaroli ..... A63B 69/3614 473/220
7,077,757 B1 * 7/2006 Payne ..... A63B 53/0466 473/238
7,666,108 B2 * 2/2010 Bryant ..... A63B 53/0487 473/288
7,918,745 B2 * 4/2011 Morris ..... A63B 53/0487 473/252
8,556,742 B2 * 10/2013 John ..... A63B 53/0466 473/219
9,895,585 B2 * 2/2018 Kroloff ..... A63B 53/0487
9,962,582 B2 * 5/2018 Antku ..... A63B 53/0466
10,646,758 B2 * 5/2020 Schweigert ..... A63B 60/02
10,758,805 B2 * 9/2020 Jung ..... A63B 69/3685
2004/0219987 A1 * 11/2004 Scott ..... A63B 69/3685 473/200
2010/0062870 A1 * 3/2010 Pouliot ..... A63B 53/007 473/251
2015/0306477 A1 * 10/2015 Parsons ..... A63B 53/0487 473/251

(Continued)

*Primary Examiner* — Stephen L Blau
(74) *Attorney, Agent, or Firm* — Elevated IP, LLC

(57) ABSTRACT

Unlike earlier visual alignment aids, the present devices and methods may transfer focus away from a central sight line to a plurality of multicolored auxiliary sight lines. The multicolored sight lines are typically brightly colored to maintain the player's focus and help avoid head movement during initiation of the swing. Further, in some embodiments, the central and/or auxiliary sight lines are dashed, with the dashes either aligned or offset from one another. In this way, hyper-acuity becomes two-dimensional with sight lines running in a first dimension (e.g., from face-to-back, when markings are on the crown, or top-to-bottom, when markings are on the face) and cross lines, made up of inter-sight line dashes, running in a second dimension (e.g., from heal-to-toe).

13 Claims, 6 Drawing Sheets

(56) References Cited

U.S. PATENT DOCUMENTS

| | | | | |
|---|---|---|---|---|
| 2017/0036078 | A1 | 2/2017 | Serrano et al. | |
| 2017/0144038 | A1* | 5/2017 | Nessar | A63B 53/0487 |
| 2020/0001151 | A1* | 1/2020 | Schweigert | A63B 60/02 |
| 2021/0121747 | A1* | 4/2021 | Parsons | A63B 60/52 |

* cited by examiner

HYPER-ACUITY GOLF CLUB SIGHT LINES

CROSS-REFERENCE TO RELATED APPLICATIONS

None.

BACKGROUND

Hyper-acuity, in the context of visual perception, refers to the ability of humans to recognize image features that are below the physical resolution limit of the eye. The classic example of hyper-acuity is the ability of humans to discern misalignment of a border at 5-10 times lower resolution than expected based on distances between receptors on the retina.

Golfers have implemented the hyper-acuity principle in alignment aids to ensure the striking face of a golf club is squarely aligned with a golf ball during shot setup. Examples of some visual alignment aids are disclosed, for example, in U.S. Pat. Nos. 5,720,668 and 4,128,244, US Patent Pub. No. 2017/0036078, and German Utility Model DE202016007255U1. However, known devices do not take full advantage of the hyper-acuity principle.

SUMMARY

Unlike earlier visual alignment aids, the present devices and methods may transfer focus away from a central sight line to a plurality of multicolored auxiliary sight lines. The multicolored sight lines are typically brightly colored to maintain the player's focus and help avoid head movement during initiation of the swing. Further, in some embodiments, the central and/or auxiliary sight lines are dashed, with the dashes either aligned or offset from one another. Optionally, the dashes form a line in a plane substantially parallel to the golf club face. In this way, hyper-acuity becomes two-dimensional with sight lines running in a first dimension (e.g., from face-to-back, when markings are on the crown, or top-to-bottom, when markings are on the face) and cross lines, made up of inter-sight line dashes, running in a second dimension (e.g., from heal-to-toe).

In an aspect, a golf club comprises a shaft connected to a head, the head having a substantially planar front face and a plurality of sight lines, wherein at least one of the sight lines is multicolored.

In an embodiment, the plurality of sight lines forms a two-dimensional pattern. In an embodiment, the two-dimensional pattern comprises sight lines and cross lines. In an embodiment, the sight lines are substantially parallel to one another and the cross lines are substantially parallel to one another.

In an embodiment, the multicolored sight line comprises at least two colors along a longitudinal axis, a lateral axis, or both longitudinal and lateral axes of the multicolored sight line. In an embodiment, each sight line has a width between 1 millimeter and 5 millimeters and an overall length between 5 millimeters and 2 centimeters. In an embodiment, a lateral distance between sight lines is between about 2 millimeters and 1 centimeter.

In an embodiment, colors of the multicolored sight line(s) are spatially separate from one another. In an embodiment, colors of the multicolored sight line(s) are touching and distinct. In an embodiment, colors of the multicolored sight line(s) are touching and indistinct.

In an embodiment, the multicolored sight lines comprise at least two colors. In an embodiment, the sight lines are on a white background. In an embodiment, sight lines are applied with no background other than the original club material(s). In an embodiment, colors of the multicolored sight lines are continuously alternated along a longitudinal axis of a sight line.

In an embodiment, each of the plurality of sight lines is substantially linear.

In an embodiment, the plurality of sight lines comprises a central line(s) and at least two outer lines, the outer lines disposed on either side of the central line(s). In an embodiment, the outer lines are the same single color or have the same multicolored pattern as one another. In an embodiment, the central line(s) is/are a single color or multicolored. In an embodiment, the central line(s) and the outer lines may be of the same or different widths relative to one another. In an embodiment, a width between the outer lines is less than or equal to a width of a golf ball.

In an embodiment, a single colored sight line and/or a multicolored sight line may be segmented, broken or dashed. In an embodiment, segments of a single color sight line and segments of a multicolor sight line are offset or aligned relative to one another. In an embodiment, segments of a single color sight line and segments of a multicolor sight line form a cross line extending from a heal of the club head to a toe of the club head. In an embodiment, a cross line is substantially parallel to a face of the club head.

In an embodiment, the golf club comprising the sight lines disclosed herein is a wood, a driver, an iron, a wedge, a hybrid or a putter.

In an embodiment, at least one of the sight lines is disposed on a crown portion of the golf club. In an embodiment, the plurality of sight lines is disposed on a crown portion of the golf club.

In an embodiment, at least one of the sight lines is disposed on a face portion of the golf club. In an embodiment, the at least one sight line disposed on the face portion of the golf club is at least partially or completely within a plurality of grooves on the face portion of the golf club. In an embodiment, the at least one sight line is at least partially or completely disposed on bottom surfaces of the grooves on the face portion of the golf club.

In an embodiment, the plurality of sight lines is disposed on a face portion of the golf club. In an embodiment, the plurality of sight lines disposed on the face portion of the golf club is at least partially or completely within a plurality of grooves on the face portion of the golf club. In an embodiment, the plurality of sight lines is at least partially or completely disposed on bottom surfaces of the grooves on the face portion of the golf club.

In an embodiment, the sight lines are formed of a material selected from the group consisting of paint, enamel, plastic, anodized metal, encapsulated liquid and combinations thereof.

In an embodiment, the sight lines are substantially flush with existing surfaces of the golf club so as not to substantially interfere with drag dynamics of the golf club. For example, the sight lines may be inlaid in one or more surfaces of the golf club and/or painted onto one or more surfaces of the golf club.

In an embodiment, the sight lines are substantially parallel to one another. In an embodiment, the sight lines are substantially perpendicular to the surface of the front face of the golf club. In an embodiment, the sight lines are greater than or less than 90 degrees with respect to the front face of the golf club to provide alignment correction for a slice, draw, fade or hook.

In an aspect, a method of making a golf club comprises providing a club head attached to a shaft, the club head having a substantially planar front face and applying a plurality of sight lines to the club head, wherein at least one of the sight lines is multicolored.

Golf clubs disclosed herein may be manufactured by techniques known in the art, including, but not limited to, forging; CNC machining; additive manufacturing; laminating together layers of metal, wood, carbon fiber, plastic, foam and combinations thereof.

BRIEF DESCRIPTION OF THE DRAWINGS

Illustrative embodiments of the present invention are described in detail below with reference to the attached drawings, wherein.

DETAILED DESCRIPTION

Figure 1A:
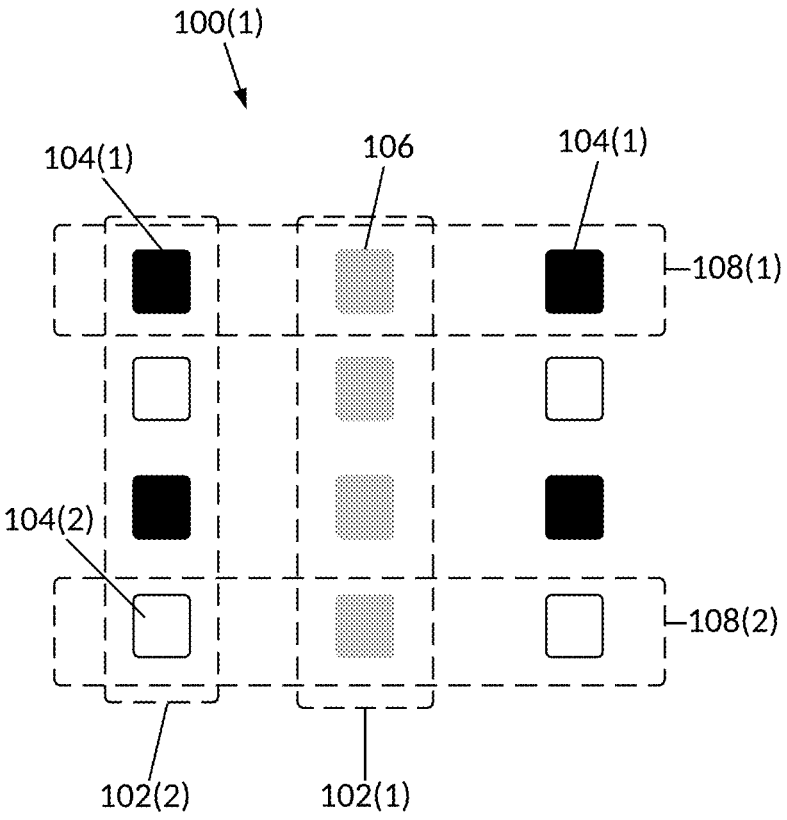
FIG. 1A is a schematic showing a plurality of sight lines forming a two-dimensional pattern of sight lines and aligned cross lines, according to an embodiment.

In general, the terms and phrases used herein have their art-recognized meaning, which can be found by reference to standard texts, journal references and contexts known to those skilled in the art. The following definitions are provided to clarify their specific use in the context of this description.

As used herein, a "multicolored" line comprises at least two different colors that are distinguishable by the human eye.

As used herein, a "sight line" is a contiguous or broken line on a golf club crown or face, where the sight line is oriented substantially parallel to a direction of intended ball travel.

As used herein, a "cross line" is a broken line formed by aligned segments of at least two sight lines, the cross line being substantially perpendicular to a direction of intended ball travel. A space between segments forming the cross line is optionally occupied by non-conforming segments of another sight line, e.g., a contiguous sight line or a segmented sight line having larger or smaller segments than those forming the cross line.

As used herein, a "two-dimensional pattern" comprises at least two sight lines and at least two cross lines.

As used herein, "aligned" describes the relative positions of objects each having two exterior points or edges connectable by a set of parallel lines, the parallel lines being substantially parallel or perpendicular to a direction of intended ball travel.

As used herein, "offset" describes the relative positions of two objects that are unaligned and non-intersecting. A two-dimensional pattern that is "completely offset" excludes any physical portion of an unaligned object from the area between aligned objects.

As used herein, "substantially" means plus or minus ten percent of the stated value.

"Proximal" and "distal" refer to the relative positions of two or more objects, planes or surfaces. For example, an object that is close in space to a reference point relative to the position of another object is considered proximal to the reference point, whereas an object that is further away in space from a reference point relative to the position of another object is considered distal to the reference point.

The terms "direct and indirect" describe the actions or physical positions of one object relative to another object. For example, an object that "directly" acts upon or touches another object does so without intervention from an intermediary. Contrarily, an object that "indirectly" acts upon or touches another object does so through an intermediary (e.g., a third object).

Exemplary alignment aid patterns can be seen in FIGS. 1-6, which are described hereafter using reference numerals without parentheses for a genus, e.g., sight lines 102, and reference numerals with parentheses for species within the genus, e.g., outer sight line 102(2). Multiple items within a figure may not be labeled for clarity. Dashed lines are for illustrative purposes only; they should not be construed as designating feature boundaries.

FIG. 1A is a schematic showing a plurality of sight lines 102 forming a two-dimensional pattern 100(1). Sight lines 102 include a dashed, single colored center sight line 102(1) and two dashed, multicolored outer sight lines 102(2). As shown, sight line segments 104(1) and 104(2) of outer sight lines 102(2) and sight line segments 106 of center sight line 102(1) are aligned to form a plurality of cross lines 108(1) and 108(2). Both sight lines 102 and cross lines 108 allow a player to benefit from hyper-acuity alignment.

Figure 1B:
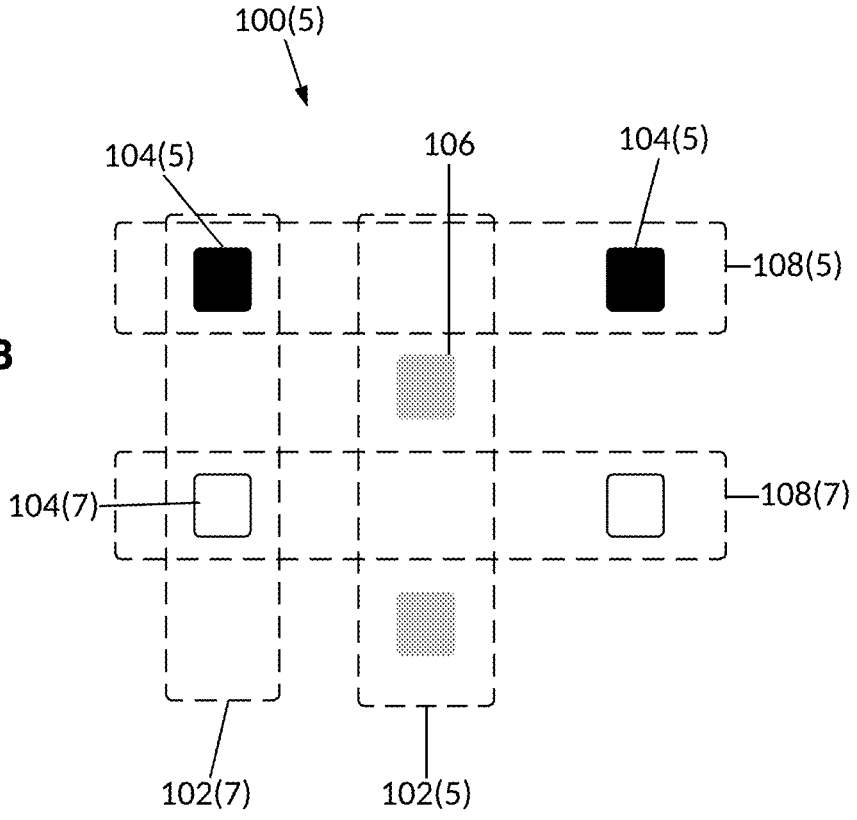
FIG. 1B is a schematic showing a plurality of sight lines forming a two-dimensional pattern of sight lines and offset cross lines, according to an embodiment.

FIG. 1B is a schematic showing a plurality of sight lines 102 forming a two-dimensional pattern 100(5). Sight lines 102 include a dashed, single colored center sight line 102(5) and two dashed, multicolored outer sight lines 102(7). As shown, sight line segments 104(5) and 104(7) of outer sight lines 102(7) and sight line segments 106 of center sight line 102(5) are offset and to form a plurality of cross lines 108(5) and 108(7). Both sight lines 102 and cross lines 108 allow a player to benefit from hyper-acuity alignment.

Figure 2:
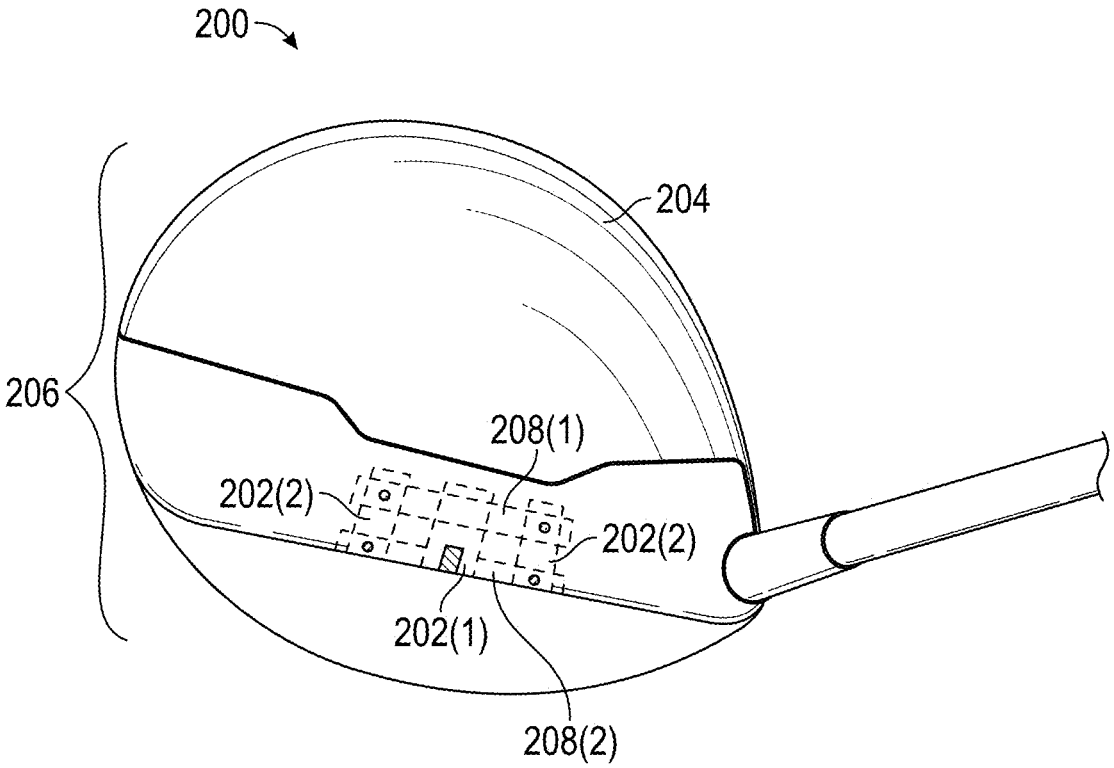
FIG. 2 is a top perspective view of a driver comprising sight lines on a crown of the club head, according to an embodiment.

FIG. 2 is a top perspective view of a golf club driver 200 comprising a plurality of sight lines 202 on a crown 204 of the club head 206. The sight lines 202 include a solid, single-colored center sight line 202(1) and two dashed, multicolored outer sight lines 202(2) comprising the same colors and patterns as one another. As shown, the dashed segments of the outer sight lines 202(2) are aligned to form cross lines 208(1) and 208(2).

Figure 3B:
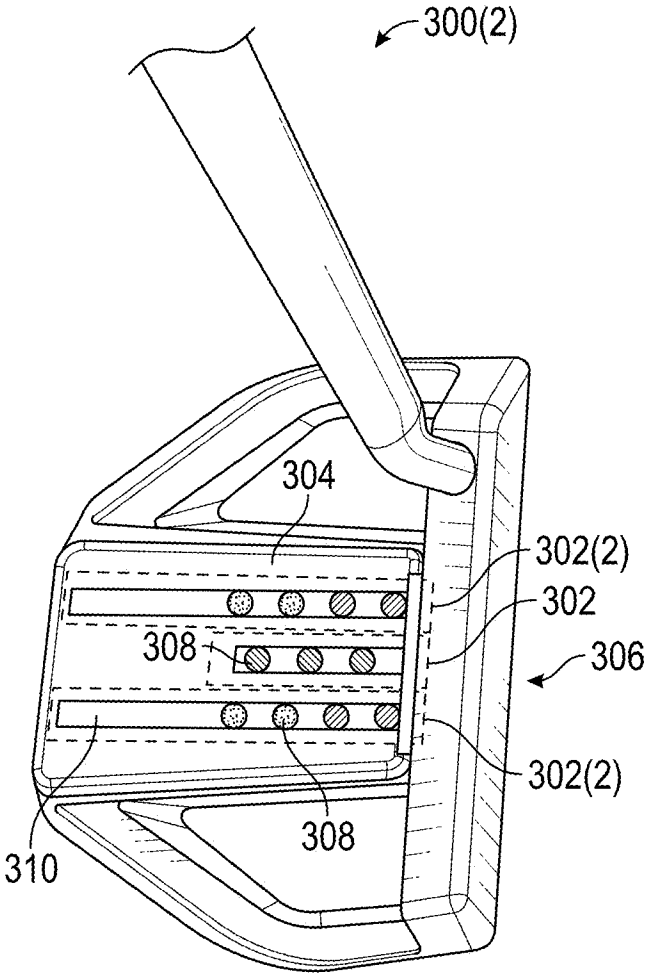
FIGS. 3A and 3B show top perspective views of putters comprising sight lines on tops of the club heads, according to multiple embodiments.
Figure 3A:
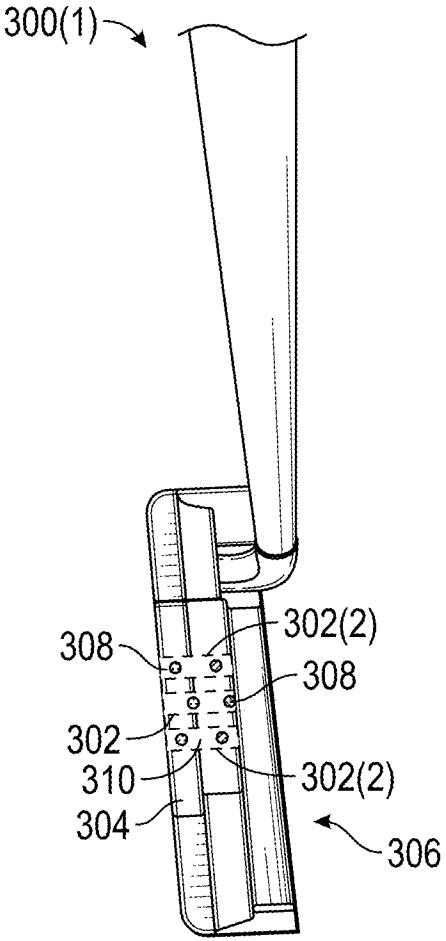

FIGS. 3A and 3B show top perspective views of putters 300(1) and 300(2) comprising sight lines 302 on tops 304 of the club heads 306. Both figures show three, dashed sight lines 302 with offset segments 308 on a white background 310. The two-dimensional patterns shown differ in the number of dashes in each sight line 302 and the multicolored patterns of the outer sight lines 302(2).

Figure 4:
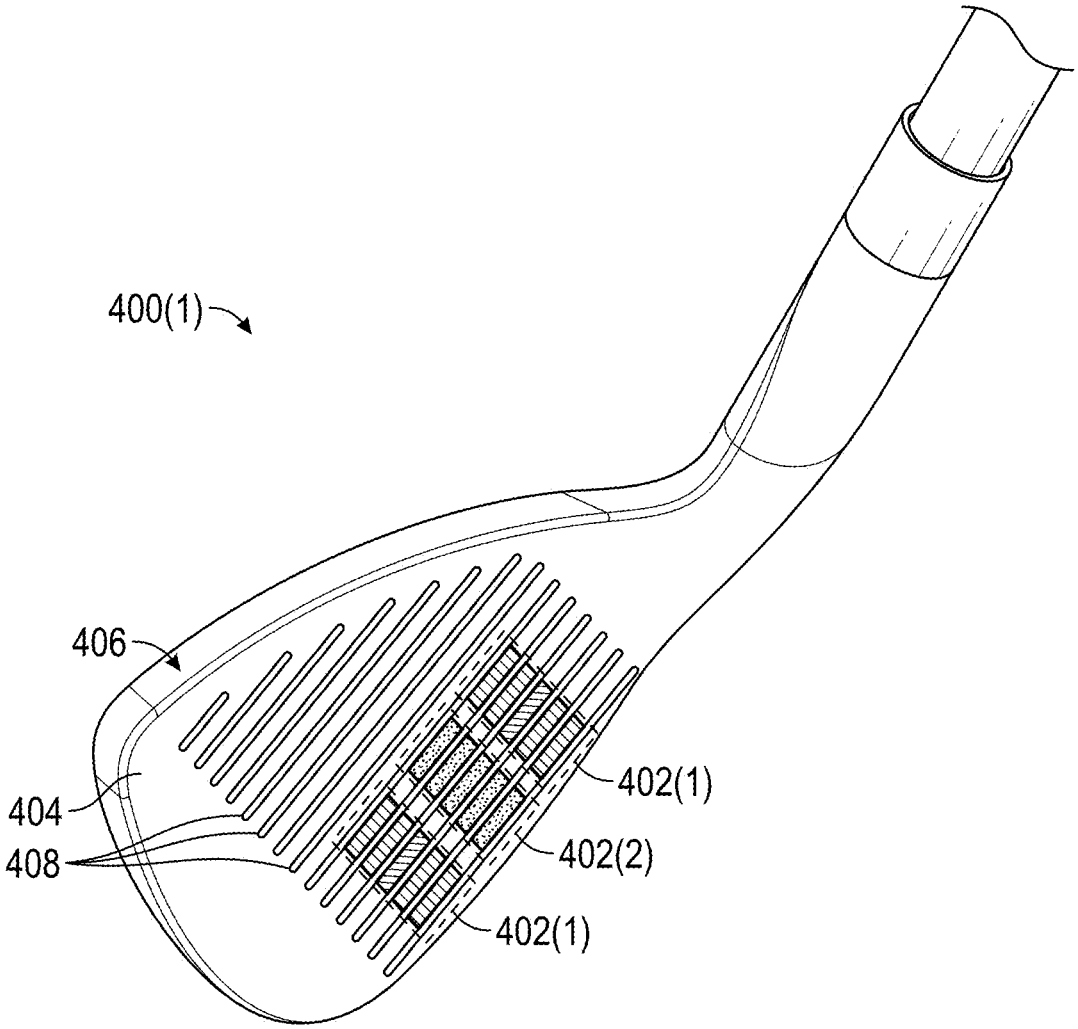
FIG. 4 is a top perspective view of an iron comprising sight lines on a face portion of the club head with sight lines intersecting the plurality of grooves but not disposed within the grooves, according to an embodiment.

FIG. 4 is a top perspective view of an iron 400(1) comprising sight lines 402(1) and 402(2) on a face portion 404 of the club head 406 with sight lines 402 intersecting the plurality of grooves 408 but not disposed within the grooves 408.

Figure 5:
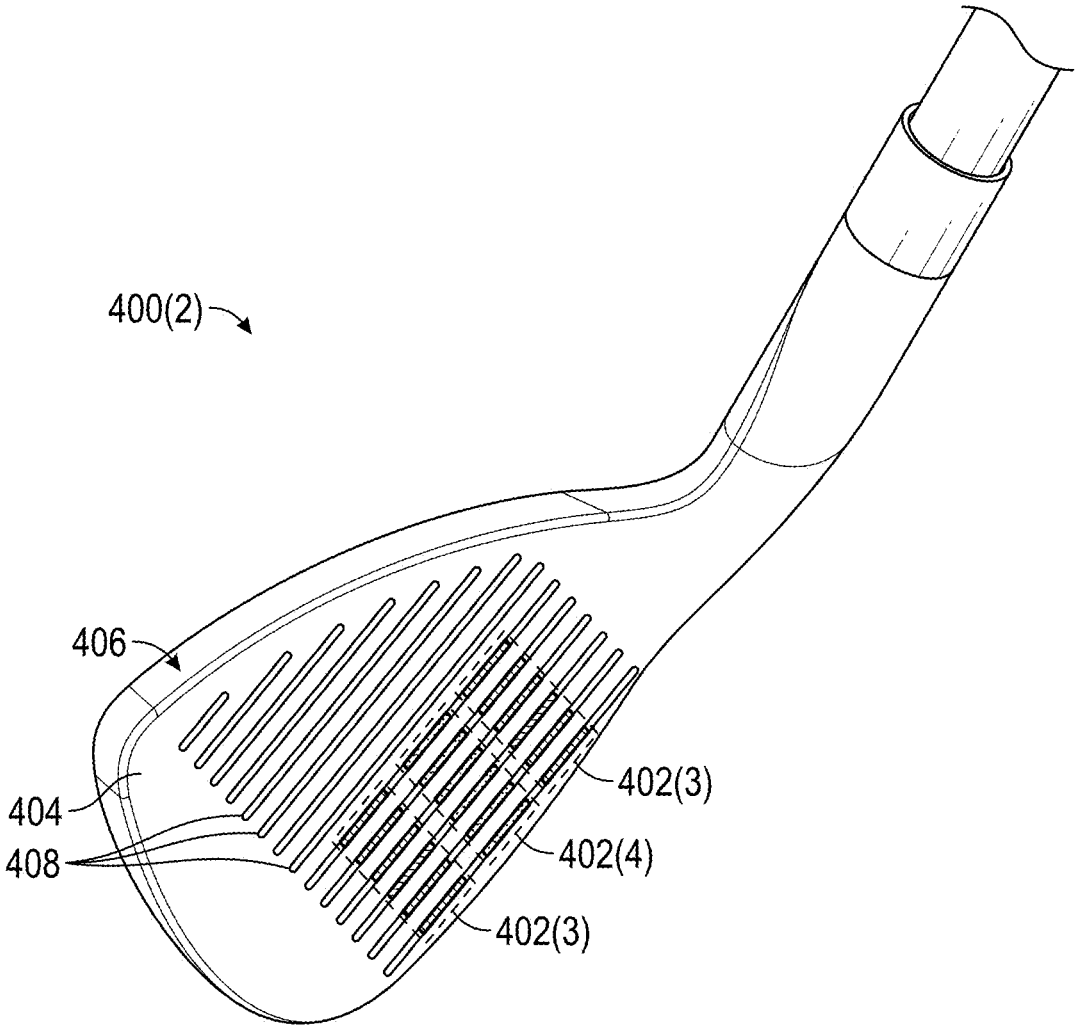
FIG. 5 is a top perspective view of an iron comprising sight lines on a face portion and completely within a plurality of grooves of the club head, according to an embodiment.

FIG. 5 is a top perspective view of an iron 400(2) comprising sight lines 402(3) and 402(4) on a face portion 404 and completely within a plurality of grooves 408 of the club head 406.

Figure 6:
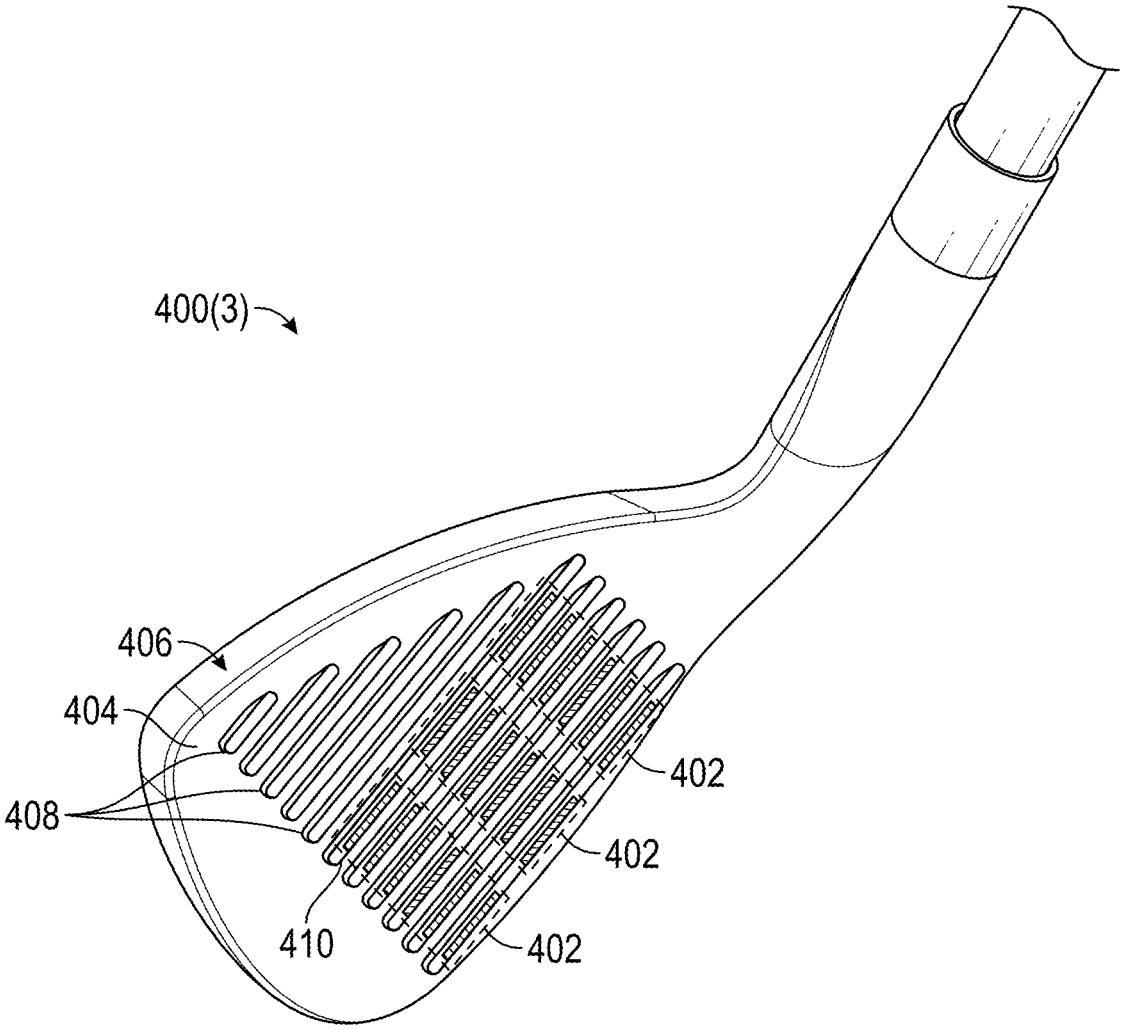
FIG. 6 is a top perspective view of an iron comprising sight lines on a face portion and only bottom surfaces of grooves of the club head, according to an embodiment.

FIG. 6 is a top perspective view of an iron 400(3) comprising sight lines 402 on a face portion 404 and only bottom surfaces 410 of grooves 408 of the club head 406, such that the colors on the bottom surfaces 410 are viewable by a player standing over the golf club.

Any of the sight lines shown in FIGS. 4-6 may comprise aligned or offset dashes that create cross lines. For example, an offset embodiment may contain portions of outer sight lines in odd-numbered grooves and portions of a central sight line(s) in even-numbered grooves.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a groove" includes a plurality of such notches and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements or limitation or limitations which is/are not specifically disclosed herein.

All art-known functional equivalents of materials and methods are intended to be included in this disclosure. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

What is claimed is:

1. A golf club comprising:

a shaft connected to a head, the head having a substantially planar front face and a back;

and a plurality of sight lines disposed at a mid-point between a heel and a toe of the head, each of the sight lines oriented perpendicular to the substantially planar front face, wherein the plurality of sight lines comprises a central line and two outer lines, and wherein at least one of the sight lines varies in color between the front face and the back.

2. The golf club of claim 1, wherein the plurality of sight lines forms a two dimensional pattern.

3. The golf club of claim 2, wherein the two-dimensional pattern comprises sight lines and cross lines.

4. The golf club of claim 1, wherein the two outer lines are multicolored lines varying in color between the front face and the back.

5. The golf club of claim 4, wherein colors of the multicolored sight line(s) are spatially separate from one another.

6. The golf club of claim 4, wherein colors of the multicolored sight line(s) are touching and distinct.

7. The golf club of claim 4, wherein colors of the multicolored sight line(s) are touching and indistinct.

8. The golf club of claim 1, wherein the central line is a multicolored line varying in color between the front face and the back.

9. The golf club of claim 1, wherein the outer lines have the same multicolored pattern.

10. The golf club of claim 1, wherein the golf club is a wood, a driver, a hybrid or a putter.

11. The golf club of claim 1, wherein at least one of the sight lines is disposed on a crown portion of the golf club.

12. The golf club of claim 1, wherein the plurality of sight lines is disposed on a crown portion of the golf club.

13. The golf club of claim 1, wherein the sight lines are substantially flush with existing surfaces of the golf club.

* * * * *